US006750185B2

(12) United States Patent
Ryu et al.

(10) Patent No.: US 6,750,185 B2
(45) Date of Patent: Jun. 15, 2004

(54) LUBRICATING OIL COMPOSITION FOR INTERNAL COMBUSTION ENGINES

(75) Inventors: Sonmin Ryu, Saitama (JP); Shuzo Nemoto, Saitama (JP); Satoshi Ogano, Fujimi (JP)

(73) Assignee: TonenGeneral Sekiyu K.K., Saitama (JP)

( * ) Notice: Subject to any disclaimer, the term of this patent is extended or adjusted under 35 U.S.C. 154(b) by 0 days.

(21) Appl. No.: 10/112,115

(22) Filed: Mar. 29, 2002

(65) Prior Publication Data

US 2003/0191033 A1 Oct. 9, 2003

(30) Foreign Application Priority Data

Apr. 2, 2001 (JP) ..... 103505/01

(51) Int. Cl.[7] ..... C10M 129/16; C10M 129/74; C10M 133/08

(52) U.S. Cl. ..... 508/485; 508/501; 508/555; 508/559; 508/561; 508/562; 508/579

(58) Field of Search ..... 508/579, 501, 508/562, 559, 555, 485

(56) References Cited

U.S. PATENT DOCUMENTS

| | | | | | |
|---|---|---|---|---|---|
| 3,657,129 | A | * | 4/1972 | Obermeier | 508/559 |
| 3,711,406 | A | * | 1/1973 | Lowe | 508/399 |
| 4,043,925 | A | * | 8/1977 | Felton, Jr. | 508/173 |
| 4,231,883 | A | * | 11/1980 | Malec | 508/412 |
| 4,336,149 | A | | 6/1982 | Erdman | 252/56 R |
| 4,376,056 | A | * | 3/1983 | Erdman | 508/501 |
| 4,402,845 | A | * | 9/1983 | Zoleski et al. | 508/579 |
| 4,438,005 | A | * | 3/1984 | Zoleski et al. | 508/501 |
| 4,704,217 | A | * | 11/1987 | Sweeney et al. | 508/373 |
| 5,204,012 | A | | 4/1993 | Schaffhausen | 252/52 A |
| 6,403,541 | B1 | * | 6/2002 | Kambara et al. | 508/579 |
| 6,458,750 | B1 | * | 10/2002 | Dardin et al. | 508/501 |

FOREIGN PATENT DOCUMENTS

| | | | |
|---|---|---|---|
| CA | 1136606 | 11/1982 | |
| DE | 19909401 A1 | 9/2000 | C10M/145/26 |
| EP | 0092946 B1 | 3/1988 | C10M/141/02 |
| EP | 0524783 A1 | 1/1993 | C10M/111/04 |
| WO | WO00/23544 | 4/2000 | C10M/145/36 |

OTHER PUBLICATIONS

Abstract—Derwent Publications Ltd., London, GB; AN 1993–331664, XP–002205917 and JP 5239485 A (Cosmo Oil Co. Ltd.), Sep. 17, 1993.

Abstract—Patent Abstracts of Japan, vol. 010, No. 373 (C–391), Dec. 12, 1986 and JP 61166892 A, (Nippon Oil Co. Ltd.), Jul. 28, 1986.

Kokoku 5–83599 (Toyota) Derwent 1986—86–194186/30.

Kokoku 1–48319/Kokai JP57205493 (Nippon Oil) Derwent 1983—10620 K/05.

William C. Griffin, "Classification of Surface–Active Agents by HLB", Oct. 11, 1949, Journal of Society of Cosmetic Chemists.

* cited by examiner

*Primary Examiner*—Ellen M McAvoy
(74) *Attorney, Agent, or Firm*—Linda M. Scuorzo; Norby L. Foss

(57) ABSTRACT

The invention provides a lubricant oil composition useful for reduction in friction loss and improvement in fuel economy in internal combustion engines, particularly, a lubricant oil composition for internal combustion engines exhibiting an excellent friction reducing effect even in a diesel engine equipped with EGR accompanied with an increase in soot content in oil. The invention is a lubricant composition for internal combustion engines comprising a lubricant base oil consisting of a mineral oil and/or synthetic oil or the like incorporated with 1 wt % or more, based on the total weight of the lubricant oil composition, a nonionic surfactant with alkylene oxide added thereto consisting of at least one compound having an HLB value of 15 or more and a molecular weight of 900 or more, and a friction reducing method for internal combustion engines using this lubricant oil composition.

3 Claims, No Drawings

LUBRICATING OIL COMPOSITION FOR INTERNAL COMBUSTION ENGINES

FIELD OF THE INVENTION

This invention relates to a lubricant oil composition for internal combustion engines and a friction reducing method for internal combustion engines and, more specifically, relates to a lubricant oil composition useful for reduction of friction loss and improvement in fuel economy in automotive internal combustion engines, particularly a lubricant oil composition for internal combustion engines suitable for lubrication of diesel engines equipped with an exhaust gas recirculation system (hereinafter often referred to as "EGR").

BACKGROUND OF THE INVENTION

Lubricant oils are used for sliding parts of internal combustion engines, for example, piston rings, cylinder liners, crankshafts, bearings for connecting rods, valve system mechanisms including cams and valve lifters, and the like. However, because of their large energy loss by friction, in general, various techniques have been developed to reduce the friction loss and improve the fuel economy. As a friction reducing agent to be added to lubricant oils to reduce the friction coefficients of lubricant oils, for example, attention is paid to organic molybdenum compounds, and a combination of organic molybdenum compound with metallic detergent (e.g., Kokoku publication No. 6-62933), a combination of organic molybdenum compound with sulfur compound (e.g., Kokoku publication No. 5-83599) and the like have been proposed. As a friction reducing agent different from the organic molybdenum compounds, further, a combination of glycerol partial ester of fatty acid with organic copper compound (e.g., Kokoku publication No. 3-77837), a combination of pentaerythritol with succinimide or zinc dithiophosphate (Kokoku publication No. 55-80494), and the like have also been proposed.

However, the production of soot resulting from incomplete combustion of diesel fuel cannot be avoided in a diesel engine, unlike a gasoline engine, and the engine oil is contaminated with the produced soot. Accordingly, conventional friction reducing agents such as organic molybdenum compound, amine compounds, amide compounds and the like involve a difficulty in that a sufficient effect cannot be exhibited due to the influence of the soot in oil. To improve the fuel economy of diesel engines, only the mixing with alkali metal borate hydrate (e.g., Kokoku publication No. 1-48319) has been proposed.

From the viewpoint of prevention of global warming, measures of reducing $CO_2$ emission are increasingly required, and it is requested in Japan, for example, to improve the fuel consumption of diesel passenger cars by 14.9% on the average (compared with 10–15 mode fuel consumption/'95) from the 2005.

In the installation of the EGR system as the measures of reducing NOx emissions from diesel engines, the soot in oil is still increased to aggravate the wear of valve systems and pistons/cylinders by the soot, and the fuel economy effect by the friction reducing agent cannot be fully exhibited. There is an increasing expectation for development of fuel economy techniques for diesel engine oils, and the development of lubricant oil compositions for internal combustion engines capable of reducing the wear in the presence of soot is desired.

SUMMARY OF THE INVENTION

The subject of this invention is to provide a lubricant oil composition capable of reducing friction of internal combustion engines even in the presence of the soot resulting from incomplete combustion of fuel, particularly, a lubricant oil composition suitable for diesel engines equipped with EGR.

In the view of the problems of the prior arts as described above, the present inventors have found, that a lubricant oil composition obtained by mixing a nonionic surfactant with a specified alkylene oxide added thereto with a lubricant base oil is effective even under a lubricating conditions with soot in the oil, and an enhanced friction reducing effect can be exhibited by controlling its hydrophile lipophile balance ("HLB") value and molecular weight, reaching the completion of this invention on the basis of such a knowledge.

This invention relates first to a lubricant oil composition comprising a lubricant base oil incorporated with 0.01 wt % or more, based on the total weight of the lubricant oil composition, of a nonionic surfactant with alkylene oxide added thereto consisting of at least one compound with an HLB value of 15 or more and a weight average molecular weight (hereinafter referred to as "molecular weight" for short) of 900 or more.

This invention relates secondly to a friction reducing method for internal combustion engines comprising, in an internal combustion engine in which a lubricant oil for sliding parts is contaminated with soot present in combustion exhaust gas, using a lubricant oil composition for internal combustion engines comprising a lubricant base oil incorporated with 0.01 wt % or more, based on the total weight of the lubricant oil composition, of a nonionic surfactant with alkylene oxide added thereto consisting of at least one compound with an HLB value of 15 or more and a molecular weight of 900 or more in the presence of the soot in oil.

As described above, this invention provides a lubricant oil composition for internal combustion engine comprising a lubricant base oil incorporated with an alkylene oxide-added nonionic surfactant consisting of a compound with an HLB value of 15 or more and a molecular weight of 900 or more, and a friction reducing method for internal combustion engine using this lubricant oil composition for internal combustion engines, and this invention involves the following (1) to (7) as preferable embodiments.

(1) A lubricant oil composition for internal combustion engines according to the above wherein the alkylene oxide-added nonionic surfactant is formed of a compound comprising a lipophilic group component having a bond group introduced thereto and a hydrophilic group component and containing an alkylene oxide group.

(2) A lubricant oil composition for internal combustion engines according to the above wherein the alkylene oxide-added nonionic surfactant contains at least one compound selected from the group consisting of compounds represented by the following general formulae (I) to (VI).

Chemical Formula 1

$$R^1—O-(R_1O)_n-H \quad (I)$$

Chemical Formula 2

$$R^2—COO-(R_2O)_n-R^{22} \quad (II)$$

Chemical Formula 3

$$[R^3—COO]_p-Y-[O-(R_3O)_n-H]_q \quad (III)$$

Chemical Formula 4

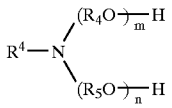

Chemical Formula 5

(V)

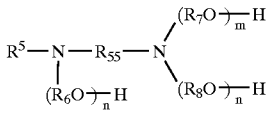

Chemical Formula 6

(VI)

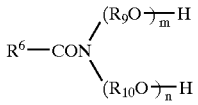

In the above general formulae (I) to (VI),

1. $R^1$, $R^2$, $R^3$, $R^4$, $R^5$ and $R^6$, which may be the same or different, each represents an alkyl group having 8–30 carbon atoms; an alkenyl group having 8–30 carbon atoms; an aromatic hydrocarbon group having 6–30 carbon atoms; or an aromatic hydrocarbon group substituted by at least one alkyl group or alkenyl group having 8–24 carbon atoms.
2. $R^{22}$ represents hydrogen atom or —$OCR^2$.
3. $R_1$–$R_{10}$, which may be the same or different, each represents an alkylene group.
4. m and n, which may be the same or different, each represents the polymerization number of alkylene oxides.
5. Y represents the frame part of a polyhydric alcohol component.
6. p and q each represents an integer of 1 or more, and the total thereof is not more than the number of hydroxyl groups of the polyhydric alcohol.
7. $R_{55}$ represents an alkylene group.

(3) A lubricant oil composition for internal combustion engines according to the above wherein $R^1$, $R^2$, $R^3$, $R^4$, $R^5$ and $R^6$ in the above general formulae (I) to (VI), which may be the same or different, each represents an alkyl group or alkenyl group having 17–24 carbon atoms.

(4) A lubricant oil composition for internal combustion engines according to the above wherein $R^1$, $R^2$, $R^3$, $R^4$, $R^5$ and $R^6$, which are the same or different, each represents a phenyl group substituted by at least one alkyl group or alkenyl group having 8–18 carbon atoms.

(5) A lubricant oil composition for internal combustion engines according to the above wherein at least either the polymerization number of alkylene oxides m or n in the alkylene oxide-added nonionic surfactant is 15 or more per molecule.

(6) A lubricant oil composition for internal combustion engines according to the above wherein 0.01 wt % or more, based on the total weight of the lubricant oil composition, of zinc dialkyldithiophosphate, 0.01–30 wt % of a non-dispersion type ethylene-propylene copolymer, and 0.01–0.5 wt % of succinimide in terms of nitrogen are further mixed to the lubricant base oil.

(7) A friction reducing method for internal combustion engines according to the above wherein the soot content in oil in the internal combustion engine is 0.1 wt % or more.

DETAILED DESCRIPTION OF THE PREFERRED EMBODIMENTS

This invention is further described in detail below.

Lubricant Base Oil

The lubricant base oil as the component of the lubricant oil composition of this invention is not particularly limited, and any one which is normally used as the base oil for lubricant oils for internal combustion engines can be used. In other words, it may be a mineral oil, a synthetic oil or a mixture thereof. A vegetable base oil is also usable.

As the mineral base oil, a mineral oil such as solvent-refined raffinate or hydrogen-treated oil obtained by treating a lubricant fraction obtained as the vacuum distillate of the atmospheric distillation residual oil of a paraffin, intermediate or naphthene base crude oil by use of a process optionally selected from various purification processes, e.g., solvent refining, hydrocracking, hydrogen treating, hydrogenation extraction, catalytic dewaxing, clay treatment and the like; a mineral oil obtained by subjecting the vacuum distillation residual oil to solvent deasphalting, and treating the resulting deasphalted oil by the above purification process, a mineral oil obtained by isomerizing a wax content; and a mixture thereof can be used. An aromatic extractant such as phenol, furfural, N-methylpyrolidone or the like is used in the above solvent refining, while liquefied propane, MEK/toluene or the like is used as the solvent for solvent dewaxing. In the catalytic deasphalting, for example, shape selective zeolite or the like is used as the deasphalting catalyst.

Examples of the thus-obtained refined mineral oil include light-gravity neutral oil, medium-gravity oil, heavy-gravity neutral oil, bright stock and the like, and these base materials are properly mixed so as to satisfy required properties, whereby the mineral base oil can be produced.

Examples of the synthetic base oil include poly α-olefin oligomer is [e.g., poly(1-hexene), poly(1-octene), poly(1-decene) etc., and mixture thereof], polybutene, alkylbenzene (e.g., dodecylbenzene, tetradecylbenzene, di(2-ethylhexyl) benzene, dinonylbenzene, etc.), polyphenyl (e.g., biphenyl, alkylated polyphenyl, etc.), alkylated diphenylether, alkylated diphenylsulfide, and derivatives thereof; esters of dibasic acid (e.g., phthalic acid, succinic acid, alkylsuccinic acid, alkenylsuccinic acid, maleic acid, azelaic acid, suberic acid, sebacic acid, fumaric acid, adipic acid, dimmer linoleate, etc.) with various alcohols (e.g., butylalcohol, hexylalcohol, 2-ethylhexylalcohol, dodecylalcohol, ethyleneglycol, diethyleneglycol, diethyleneglycol monoether, propyleneglycol, etc.); esters of monocarboxylic acid having 5–12 carbon atoms with polyols (e.g., neopentyl glycol, trimethylol propane, pentaerythritol, dipentaerythritol, tripenthaerythritol, etc.); and polyoxyalkylene glycol, polyoxyalkylene glycol ester, polyoxyalkylene glycol ether, phosphate, silicone oil and the like.

The lubricant base oil can be produced by mixing the above oil bases independently or in a combination of at least two so as to have desired viscosity and other properties. For the lubricant oil for internal combustion engines of this invention, for example, the kinematic viscosity at 100 of the base oil is adjusted in a range of 2–20 $mm^2/s$, preferably 3–15 $mm^2/s$. When the kinematic viscosity of the lubricant base oil is too high, the agitation resistance and the coefficient of friction in the hydrodynamic lubrication region are increased to deteriorate fuel saving characteristics, and when it below the above range, the wear at sliding parts such as valve systems, piston rings, bearings and bearings of internal combustion engines is increased.

Alkylene Oxide-Added Nonionic Surfactant

The alkylene oxide-added nonionic surfactant used as the component of the lubricant oil composition for internal combustion engine of this invention contains at least one compound having at least one alkylene oxide group —$(RO)_n$—H in the molecule formed of a lipophilic group component and a hydrophilic group component, which has an HLB value of 15 or more and a molecular weight of 900 or more.

The lipophilic group component is not limited, and any one, which is normally used as a lipophilic group component for nonionic surfactant and can attain the purpose of this invention, can be optionally selected. The lipophilic group component is mainly composed of a straight chain or branched saturated or unsaturated aliphatic hydrocarbon, aromatic hydrocarbon or an aromatic hydrocarbon having the aliphatic hydrocarbon as side chain to which at least one bond group such as ether (—O—), ester (—COO—), amine (—N<), amide (CON<), thioether (—S—), thioamide (—SON<) or the like is introduced. Examples of the hydrophilic component include raw materials such as alkyloxide, polyalkylene glycol, sorbitan, glycerin, dialkanol amine and the like.

The alkylene oxide-added nonionic surfactant suitable as the component of the lubricant oil composition for internal combustion engines of this invention contains at least one compound having a basic chemical structure as described above. It further has an HLB value controlled to a specified level of 15 or more as a first specific property and a molecular weight (mole number) specified to 900 or more as a second specific property.

In the description of this invention, the ratio (molecular weight of hydrophilic group part/molecular weight of surfactant) calculated according to the method proposed by W. C. Griffin [J. SOC. Cosmetic Chemists, 1, (5) 311 (1949)] is adapted as the HLB value.

When alkylene oxide-added nonionic surfactants differed in molecular weight are used as a mixture, the molecular weight is represented as an average value.

The alkylene oxide-added nonionic surfactant as the component of the lubricant oil composition of this invention contains at least one compound of the above chemical structure, and is controlled in HLB value to 15 or more and in molecular weight to 900 or more. Concretely, the alkylene oxide-added nonionic surfactant can be provided by selecting at least one of the compounds represented by the following general formulae (I) to (VI) and controlling the structure thereof.

Each of the compounds related to the alkylene oxide-added nonionic surfactants represented by the general formulae (I) to (VI) is further described.

Ether-Based Compound

The following general formula (I) represents an ether-based compound used as the alkylene oxide-added nonionic surfactant.

Chemical Formula 7

$$R^1—O—(R_1O)_nH \quad (I)$$

In the general formula (I), $R^1$ represents a straight chain or branched saturated or unsaturated aliphatic hydrocarbon group, more specifically, an alkyl group having 8–30 carbon atoms; an alkenyl group having 8–30 carbon atoms; aromatic hydrocarbon group having 6–30 carbon atoms; and an aromatic hydrocarbon group having at least one alkyl or alkenyl group having 8–24 carbon atoms as side chain.

As the terminal hydrocarbon group of the ether-based compound, particularly, an alkyl group having 17–24 carbon atoms; an alkenyl group having 17–24 carbon atoms; and a phenyl group substituted by at least one alkyl or alkenyl group having 8–18 carbon atoms are preferable from the viewpoint of ensuring a high friction reducing effect. Examples thereof include an alkyl group such as heptadecyl group, octadecyl group, nonadecyl group, eicosyl group, heneicosyl group, docosyl group, tricosyl group, pentacosyl group, hexacosyl group, heptacosyl group, etc.; an alkenyl group such as heptadecenyl group, octadecenyl group, eicocenyl group, dococenyl group, tetracocenyl group, etc.; an alkylated phenyl group such as heptylphenyl group, octylphenyl group, nonylphenyl group, decylphenyl group, dinonylphenyl group, etc.; an alkenylated phenyl group such as octenylphenyl group etc.; and isomers such as branched hydrocarbon groups thereof and the like.

When the carbon number of the above hydrocarbon group such as alkyl group or the like is less than 8, a low friction coefficient cannot be obtained under the lubricating condition contaminated with soot, and the compatibility and stability in the lubricating oil is likely to deteriorate. Even if the carbon number exceeds 30, not only the effect commensurating to the increase cannot be obtained, but also the compatibility with the base oil might be lacking.

In the above general formula (I), $R_1$ in —$(R_1O)_n$—H is the alkylene group of an alkylene oxide, and preferable examples thereof include those having 2–4 carbon atoms, e.g., ethylene group, propylene group, isopropylene group, butylene group, isobutylene group. etc. These alkylene groups may be used independently or in combination. They can be used, for example, in a form as $R^1O(C_3H_6O)_m(C_2H_4O)_nH$ or $R^1O(C_2H_4O)_m(C_3H_6O)_nH$ by introduction of a polyoxypropylene chain.

In the above general formula (I), n in —$(R_1O)_n$—H is the polymerization number of alkylene oxide, and when n is 15 or more per molecule, particularly 15–20, a more remarkable friction reducing effect can be exhibited.

The alkylene oxide-added nonionic surfactant represented by the above general formula (I) is an alkyl polyoxyalkylene ether, which can be obtained by using alkylene oxides, for example, ethylene oxide and/or propylene oxide or the like as the hydrophilic group raw material and a higher alcohol, thioalcohol, alkylphenol, polyalkylene glycol or the like as the lipophilic group raw material. More concretely, the raw materials can be optionally selected so as to be provided with the prescribed hydrocarbon group specified in the above general formula (I). Namely, the carbon number of the lipophilic group raw material such as alcohol is adjusted so that the alkyl group side chain of the alkyl group, alkenyl group, or alkylated phenyl group is 8 or more, preferably 17 or more as the terminal hydrocarbon group.

As examples of preferable starting alcohols, heptadecanol, octadecanol (stearyl), nonadecanol, eicosanol (aralkynyl), heneicosanol, docosanol, tricosanol, tetracosanol, pentacosanol and the like can be given as alkanol, and isomers thereof can also be selected. As unsaturated alcohol, oleylalcohol, elaidyl alcohol, linoleyl alcohol, linolenyl alcohol or the like can be given. Further, octylphenol, nonylphenol, decaphenol, undecaphenol or the like can be used as alkylphenol.

Typical examples of the alkyl polyoxyethylene ether represented by the general formula (I) suitable for the lubricant oil composition of this invention include stearyl polyoxyethylene ether, oleyl polyoxyethylene ether, nonylphenyl polyoxyethylene ether, dinonylphenyl polyoxyethylene ether, and the like.

Ester-Based Compound

An ester-based compound useful as the alkylene oxide-added nonionic surfactant of this invention is represented by the general formula (II).

Chemical Formula 8

$$R^2—COO—(R_2O)_n—R^{22} \quad (II)$$

In the general formula (II), $R^2$ represents an alkyl group having 8–30 carbon atoms; an alkenyl group having 8–30 carbon atoms; an aromatic hydrocarbon group having 6–30 carbon atoms; and an aromatic hydrocarbon group having an alkyl or alkenyl group having 8–24 carbon atoms as side chain. A particularly preferable alkyl or alkenyl group has 17–24 carbon atoms.

In the general formula (II), $R_2$ represents the alkylene group of an alkylene oxide group $—(R_2O)_n—R^{22}$, which may be the same as $R_1$ of the general formula (I). $R^{22}$ represents hydrogen atom or $—OCR^2$.

The fatty acid polyalkylene ester represented by the general formula (II) is obtained by esterification reaction of fatty acid with polyalkylene glycol or addition of alkylene oxide to fatty acid, which generally provides a mixture of $R^2—COO—(R_2O)_n—H$ and $R^2—COO—(R_2O)_n—OCR^2$, or a polyoxyalkeylene fatty acid monoester partially esterified with fatty acid and a polyoxyalkylene fatty acid diester having both ends entirely esterified. As the alkylene oxide-added nonionic surfactant of this invention, the former polyoxyalkylene fatty acid monoester esterified with fatty acid is preferable.

In the fatty acid component of the fatty acid polyoxyalkylene ester, a saturated fatty acid or unsaturated fatty acid having 9–30 carbon atoms is used so that the carbon number of the terminal alkyl group $R^2$ is 8 or more, preferably 17–24, and a more preferable saturated fatty acid or unsaturated fatty acid has 18–25 carbon atoms. Examples of the preferable fatty acid include saturated acid such as margaric acid, stearic acid, nonadecylic acid, arachidic acid, heneicosanic acid, behenic acid, tricosanic acid, lignoserinic acid, pentacosanic acid and cerotic acid, and 2-palmitoleic acid, oleic acid, elaidic acid, codoinic acid, erucic acid, ceracoleic acid, linolic acid, linolenic acid, etc. may be also used. When the chain length of the fatty acid is short, a sufficient friction reducing effect cannot be obtained under the lubricating condition in the presence of soot, and the stability of the lubricant oil is also weakened.

Typical examples of the thus-obtained fatty polyoxyalkylene ester of the general formula (II) include polyoxyethylene propylene glycol ester of monostearic acid, polyethylene glycol ester of monooleic acid, polyethylene glycol distearate, polyethylene glycol ester of monostearic acid, polyoxyethylene propylene glycol ester of monostearic acid and the like.

Ester-Ester Mixture-Based Compound

The compound represented by the general formula (III) is a polyhydric alcohol ester-ether mixture-based compound, which is obtained by adding an alkylene oxide to the free hydroxyl group of a fatty acid partial ester of polyhydric alcohol.

Chemical Formula 9

$$[R^3—COO]_pY[O—(R_3O)_nH]_q \quad (III)$$

In the general formula (III), $R^3$ represents an alkyl group having 8–30 carbon atoms; an alkenyl group having 8–30 carbon atoms; an aromatic hydrocarbon group having 6–30 carbon atoms; or an aromatic hydrocarbon group having at least one alkyl or alkenyl group having 8–24 carbon atoms as side chain. Particularly, an alkyl group having 17–24 carbon atoms; an alkenyl group having 17–24 carbon atoms; and a phenyl group having an alkyl or alkenyl group having 8–18 carbon atoms as side chain are preferable from the point of friction reducing effect.

In the general formula (III), $R_3$ represents the alkylene group of an alkylene oxide $—(R_3O)_n—H$, which may have 2–4 carbon atoms similarly to $R_1$ of the general formula (I). n is the polymerization number per molecule of the alkylene oxide $—(R_3O)—$. When two or more alkylene oxide groups are present in one molecule, the polymerization number thereof is 15 or more in total and, particularly, either one of them preferably have a polymerization number of 15 or more.

In the general formula (III), Y represents the frame part of a polyhydric alcohol component, and the frame part is derived from a polyhydric alcohol component having at least three hydroxyl groups. Examples of the polyhydric alcohol include glycerin, erythritol, arabitol, sorbitol, trimethylol propane, ditrimethylol propane, trimethylol ethane, pentaerythritol, dipentaerythritol, tripentaerythritol, and sorbitan obtained by intermolecular dehydration of sorbitol, and the like.

In the general formula (III), p and q are the numbers of $[R^3—(COO)—]$ and $[—O—(R_3O)_nH]$ to be bonded with hydroxyl groups of the polyhydric alcohol, respectively. Since a one having at least three hydroxyl groups is selected as the polyhydric alcohol, p and q each represents an integer of 1 or more, and the total thereof is set to a number not more than the number of hydroxyl groups of the polyhydric alcohol. A free hydroxyl group may be present therein.

In the polyhydric alcohol ester-ether mixture-based compound, the ratio of ether bond to the total of ester bonds and ether bonds is preferably set to 25–75 per molecule from the point of the lower friction.

As a typical example of the polyhydric alcohol ester-ether mixture-based compound, 1,4-sorbitan fatty acid partial ester (ester bond; 1) having three alkylene oxides added thereto has the following structure, and Y in the general formula (III) represents a chemical structure shown within the dotted line frame of this formula.

Formula 1

(Formula 1)

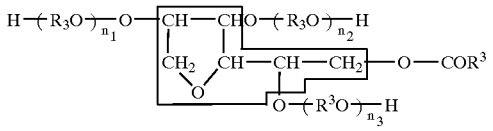

In this case, p is 1, and q is 3 in the general formula (II). Further, an example of a glycerin fatty acid partial ester (ester bond; 1) having two alkylene oxides added thereto is shown in Formula 2. In the general formula (II), p is 1, and q is 2.

Formula 2

(Formula 2)

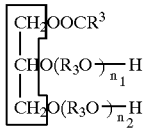

The compound of the general formula (III) can be obtained as the ester-ether mixture-based compound by adding the alkylene oxides to an alcohol fatty acid partial ester obtained by reacting the polyhydric alcohol component with a fatty acid component, or simultaneously adding the fatty acid and alkylene oxides to the polyhydric alcohol followed by reaction. As the fatty acid component, a saturated fatty acid or unsaturated fatty acid having 9–30 carbon atoms, preferably, a fatty acid or unsaturated fatty acid having 18–25 carbon atoms is used. Examples of the preferable fatty acid include a saturated acid such as stearic acid, nonadecylic acid, arachidic acid, heneicosanic acid, behenic acid, tricosanic acid, lignoserinic acid, pentacosanic acid, cerotic acid, etc., and an unsaturated acid such as oleic acid, elaidic acid, codoinic acid, erucic acid, ceracoleic acid, linolic acid, linolenic acid, etc. When the chain length of the fatty acid is short, a sufficient friction reducing effect cannot be obtained in the lubricating condition in the presence of soot, and the stability of the lubricant oil is also weakened.

Typical examples of the fatty acid polyoxyethylene polyhydric alcohol ester represented by the general formula (III) include polyoxyethylene sorbitan ester of monostearic acid (Tween 60), polyoxyethylene sorbitan ester of monooleic acid (Tween 80), polyoxyethylene sorbitan ester of monoparmitic acid, and the like.

Amine-Based and Amide-Based Compounds

The following general formulae (IV), (V) and (VI) represent amine-based compounds and amide-based compounds useful as the alkylene oxide-added nonionic surfactant concerning the lubricant oil composition of this invention.

Chemical Formula 10

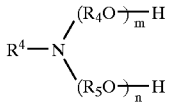

(IV)

Chemical Formula 11

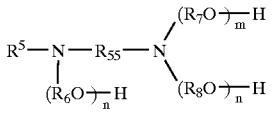

(V)

Chemical Formula 12

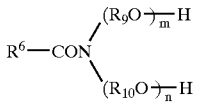

(VI)

In the general formulae (IV) to (VI), $R^4$–$R^6$, which may be the same or different, each represents an alkyl group having 8–30 carbon atoms; an alkenyl group having 8–30 carbon atoms; an aromatic hydrocarbon group having 6–30 carbon atoms; and an aromatic hydrocarbon group having an alkyl or alkenyl group having 8–24 carbon atoms as side chain. Particularly, an alkyl group having 17–24 carbon atoms and an alkylene group having 17–24 carbon atoms are preferable. $R_{55}$ represents an alkylene group having 8–30 carbon atoms.

$R_4$–$R_{10}$, which may be the same or different, each represents the alkylene group of an alkylene oxide. Each of m and n is the polymerization number of the alkylene oxide, the total of m+n is 15 or more per molecule, and either m or n is preferably 15 or more.

The alkyl polyoxyalkylene amine, alkyl polyoxyalkylene diamine, alkylpolyoxy alkylene amide represented by the general formulae (IV), (V) and (VI) which are alkylene oxide-added nonionic surfactants are obtained by reacting a higher amine of lipophilic raw material with the alkylene oxide. The alkyl polyoxyalkylene amide of the general formula (VI) is obtained by reacting a higher fatty aid amide as lipophilic raw material with the alkylene oxide.

More specifically, examples of the higher amine include primary amine such as heptadecyl amine, octadecyl amine, nonadecyl amine, eicosyl amine, tricosyl amine or the like and secondary amine such as diheptadecyl amine, dioctadecyl amine or the like.

Examples of the higher fatty acid amide include octadecane amide, eicosanamide, docosanamine or the like.

As typical examples of the alkyl polyoxyalkylene amine and alkyl polyoxyalkylene diamine of the general formulae (IV) and (V), polyoxyethylene beef tallow amine and polyoxyethylene beef tallow diamine or the like can be given.

In the lubricant oil composition of this invention, the mixing quantity of the above-mentioned alkylene oxide-added nonionic surfactant is set to 0.01 wt % or more on the basis of the total weight of the lubricant oil composition, whereby a sufficient friction reducing effect can be exhibited. The mixing quantity may be further increased to obtain a desired performance, and it is preferably set to 1–20 wt %, particularly 1–15 wt %. When the mixing quantity is less than 0.01 wt %, the friction reducing effect cannot be obtained, and when it exceeds 20 wt %, not only the friction reducing effect commensurating to the increase cannot be obtained, but also the performance of lubricant oil additives and the solubility of the lubricant base oil might be impaired.

A general binder may be mixed to the above compound as the alkylene oxide-added nonionic surfactant.

Other Additive Components

The lubricant oil composition for internal combustion engines of this invention contains, as the essential component, at least one alkylene oxide-added nonionic surfactant in the lubricant base oil, and friction inhibitor. When a friction inhibitor, a viscosity index improver and an ashless dispersant are further mixed thereto, the friction reducing effect can be further more improved in the lubricating conditions contaminated with soot.

Examples of the friction inhibitor generally include zinc dithiophosphate, metal salt (Pb, Sb, Mo, etc.) of dithiophosphoric acid, metal salt (Zn, Pb, Sb, Mo, etc.) of dithiocarbamic acid, metal salt (Pb, etc.) of naphthenic acid, metal salt (Pb, etc.) of fatty acid, boron compound, phosphate, phosphite, phosphate amine salt and the like. These are generally used in a ratio of 0.1–5 wt %. Of these, a zinc dialkyl dithiophosphate is particularly preferable. The mixing quantity thereof is set to 0.01 wt % or more, particularly preferably, 0.05–0.2 wt % as phosphor concentration on the basis of the total weight of the lubricant oil composition.

Examples of the viscosity index improver generally include polymethacrylate-based one, olefin copolymer-based (e.g., polyisobutylene-based and ethylene-propylene copolymer-based) one, polyalkyl styrene-based one, hydrogenated styrene-butadiene copolymer-based one, styrene-maleic anhydride ester copolymer-based one, stellar isoprene-based one and the like. Of these, a non-dispersion type olefin copolymer-based one (e.g., polyisobutylene-based and ethylene-propylene copolymer-based one) is more preferably used for this invention from the point of the friction reducing effect. The polyisobutylene-based or ethylene-propylene copolymer-based one particularly preferably has a weight average molecular weight of 100,000 or more (as polystyrene, determined by GPC analysis). The non-dispersion type compound means the one containing no oxygen or nitrogen in its molecular structure and showing dispersibility. These are generally used in a ratio of 0.01–30 wt % based on the total weight of the lubricant oil composition.

Examples of the ashless dispersant include succinimide, succinamide, benzylamine, succinate, succinate-amide, and boron-containing compounds thereof. Of these, a succinimide and a boron-containing succinimide are preferably used for this invention from the point of the friction reducing effect. The mixing quantity of the succinimide and boron-containing succinimide is 0.001–0.5 wt %, as nitrogen in the oil, based on the total weight of the lubricant oil composition, preferably 0.05–0.2 wt %.

A lubricant oil for internal combustion engines is required to have a variety of functions, and in order to ensure performances suitable thereto, various additives can be properly added in prescribed quantities described below, based on the total weight of the lubricant oil composition, so long as the result of this invention is not impaired. Theses additives include pour point depressant, metallic detergent, antioxidant, extreme pressure agent, metal inactivator, rust inhibitor, antifoaming agent, corrosion inhibitor, coloring agent and the like.

Examples of the pour point depressant include ethylene-vinyl acetate copolymer, condensate of chlorinated paraffin with naphthalene, condensate of chlorinated paraffin with phenol, polymethacrylate, polyalkyl styrene and the like. Of these, a polymethacrylate is particularly preferably used. These are generally used in a ratio of 0.01–5 wt %.

Examples of the metallic detergent include sulfonate, phenate, salicylate, and phosphonate of Ca, Mg, Ba, Na or the like, and these are generally used in a ratio of 0.05–5 wt %.

Examples of the antioxidant generally include amine-based one such as alkylated diphenylamine, phenyl-α-naphthylamine, alkylated phenyl-α-naphthylamine, etc.; phenol-based one such as 2,6-ditertiary butylphenol, 4,4'-methylene bis-(2,6-ditertiary butylphenol), etc.; sulfur-based one such as dilauryl-3,3'-thiodipropionate, etc.; phosphor-based one such as phosphite, etc.; zinc dithiophosphate; and the like. Of these, amine-based and phenol-based antioxidants are particularly preferably used. These are generally used in a ratio of 0.05–5 wt %.

Examples of the extreme pressure agents generally include ashless-based sulfide compound, sulfurized oil and fat, phosphate ester, phosphite ester, phosphate ester amine and the like. These are generally used in a ratio of 0.05–3 wt %.

Examples of the metal inactivator include benzotriazole, triazole derivatives, benzotriazole derivatives, thiadiazole derivatives and the like. These are used generally in a ratio of 0.001–3 wt %.

Examples of the rust inhibitor include fatty acid, alkenyl succinic acid half ester, fatty acid soap, alkylsulfonate, polyhydric alcohol fatty acid ester, fatty acid amine, paraffin oxide, alkyl polyoxyethylene ether and the like. These are used generally in a ratio of 0.01–3 wt %.

The antifoaming agent include dimethylpolysiloxane, polyacrylate and the like. These are added generally in an extremely small quantity, for example, about 0.002 wt %.

Other additives such as corrosion inhibitor, coloring agent and the like can be further used for the lubricant oil composition of this invention as required.

The lubricant oil composition containing the alkylene oxide-added nonionic surfactant of this invention can be used for lubrication of valve systems, piston rings and other sliding parts as crankcase oil for diesel engine under a general operating condition, and sufficiently reduce the friction of a diesel engine even under the lubricating conditions contaminated with 0.1 wt % or more of diesel soot.

EXAMPLES

This invention is described further in detail by the following non-limiting Examples and Comparative Examples.

The coefficient of friction and soot content in oil of the prepared lubricant oil compositions were measured according to the following method.

The alkylene oxide-added nonionic surfactant used in Examples and Comparative Examples is as follows.

Coefficient of Friction

Coefficient of friction was measured by use of a reciprocating type (SRV) friction/wear tester, and the friction/wear tests were performed under the following test conditions. The measurement result is shown by the average value of the coefficients of friction measured at each temperature.

Test Conditions

| | |
|---|---|
| Specimen (Friction material) | SUJ-2 |
| Plate | 24 mm in diameter × 7 mm |
| Cylinder | 15 mm in diameter × 22 mm |
| Temperature | 40, 50, 60, 70, 80, 90, or 100 |
| Load | 400 N |
| Amplitude | 1.5 mm |
| Frequency | 50 Hz |
| Testing period | 5 min |

Soot Content in Oil

A lubricant oil in which soot was concentrated by operation of a commercial diesel engine was collected and subjected to ultracentrifugation (centrifugal force; 36,790G, engine speed: 17,500 rpm, time: 30 min, frequency: 3, temperature: 0° C.), and the quantity of the resulting n-hexane non-dissolved content was measured as the soot content in the oil.

Alkylene Oxide-Added Nonionic Surfactant

Alkylene oxide-added nonionic surfactants were shown in Table 1 and Table 2 by the following numbers (1) to (16). The company names in parentheses are the manufactures thereof).

1. Tween 80: Ethylene oxide of sorbitan monooleate (Polyoxyethylene Sorbitan Mono-oleate) (KOSO CHEMICAL)
2. TS-10 (Tween 60): Ethylene oxide of sorbitan monostearate (Polyoxyethylene Sorbitan Mono-stearate) (NIKKO CHEMICALS)
3. NP-18PTX: Polyoxyethylene phenyl ether (Polyoxyethylene Nonoxynol) (NIKKO CHEMICALS)
4. BS-20: Polyoxyethylene stearyl ether (Polyoxyethylene Steareth) (NIKKO CHEMICALS)
5. BO-20: Polyoxyethylene oleyl ether (Polyoxyethylene Oleth) (NIKKO CHEMICALS)
6. Ethomeen S/25: Polyoxyethylene soybean amine (Polyoxyethylene Soya Amine) (LION CHEMICAL)
7. Ethomeen T/25: Polyoxyethylene beef tallow amine (Polyoxyethylene Tallow Amine) (LION CHEMICAL)
8. Ethoduomeen T/25: Polyoxyethylene beef tallow diamine (Polyoxyethylene Tallow Diamine) (LION CHEMICAL)
9. Span 85: Sorbitan trioleic acid ester (Sorbitan Tri-oleate) (KOSO CHEMICAL)

10. Span 80: Sorbitan monooleic acid ester (Sorbitan Mono-oleate) (KOSO CHEMICAL)
11. BS-4: Polyoxyethylene stearyl ether (Polyoxyethylene Steareth) (NIKKO CHEMICALS)
12. BL-4.2: Polyoxyethylene lauryl ether (Polyoxyethylene Laureth) (NIKKO CHECMIALS)
13. BT-12: Polyoxyethylene secondary alkyl ether (Polyoxyethylene Pareth) (NIKKO CHEMICALS)
14. TAMDO-5: Polyoxyethylene oleyl amide (Polyoxyethylene Oleamide) (NIKKO CHEMICALS)
15. TS-106: Ethylene oxide of sorbitan monostearate (Sorbitan Mono-oleate) (NIKKO CHEMICALS)
16. Ethomeen C/25: Polyoxyethylene coconut acid amine (Polyoxyethylene Coco Amine) (LION CHEMICAL)

Example 1

To a solvent-refined paraffin mineral oil (kinematic viscosity: 5.1 $mm^2/s$@(100° C.) were mixed 5.0 wt %, based on the total weight of the lubricant oil composition, of an ethylene oxide adduct of sorbitan monooleate with an HLB value of 19.0 and a molecular weight of 1325 (Tween 80), 5.3 wt % of a non-dispersion type ethylene-propylene copolymer (OCP) (weight average molecular weight: 200,000), 8.0 wt % of succinimide, 0.09 wt % of zinc dithiophosphate (as P), and 6.4 wt % in total of a metallic detergent, a pour point depressant and an antifoaming agent as other additives. The soot concentrated and collected by operating a commercial diesel engine with only a lubricant base oil was mixed thereto at 3.0 wt % to prepare a lubricant oil composition A.

The friction reduction-retainable highest temperature of the lubricant oil composition A was 100° C. The coefficient of friction at each temperature was measured by a SRV friction test under the above-mentioned conditions. The resulting average value was 0.044. The properties of the ethylene oxide adduct of sorbitan monooleate are shown in Table 1.

Example 2

The same components as the lubricant oil composition A of Example 1 were used except using ethylene oxide adduct of sorbitan monooleate [TS-10 (Tween 60)] with an HLB value of 15.0 and a molecular weight of 1327 shown in Table 1 instead of the ethylene oxide condensate of sorbitan monostearate (Tween 80) to prepare a lubricant oil composition B. The lubricant oil composition B had a friction reduction-retainable highest temperature of 90° C. and an average coefficient of friction of 0.051, which was measured by use of the SRV friction tester.

Example 3

The same components as the lubricant oil composition A of Example 1 were used except using a polyoxyethylene nonylphenyl ether (NP-18PTX) with an HLB value of 19.0 and a molecular weight of 1012 shown in Table 1 instead of the ethylene oxide condensate of sorbitan monooleate (Tween 80) to prepare a lubricant oil composition C. The lubricant oil composition C had a friction reduction-retainable highest temperature of 90° C. and an average coefficient of friction of 0.059.

Example 4

The same components as the lubricant oil composition A of Example 1 were used except using polyoxyethylene stearyl ether (BS-20) with an HLB value of 18.0 and a molecular weight of 1150 shown in Table 1 instead of the ethylene oxide condensate of sorbitan monooleate (Tween 80) to prepare a lubricant oil composition D. The lubricant oil composition D had a friction reduction-retainable highest temperature of 100° C. and an average coefficient of friction of 0.057.

Example 5

The same components as the lubricant oil composition A of Example 1 were used except using polyoxyethylene oleyl ether (BO-20) with an HLB value 17.0 and a molecular weight of 1150 shown in Table 1 instead of the ethylene oxide condensate of sorbitan monooleate (Tween 80) to prepare a lubricant oil composition E. The lubricant oil composition E had a friction reduction-retainable highest temperature of 100° C. and an average coefficient of friction of 0.059.

Example 6

The same components as the lubricant oil composition A of Example 1 were used except using polyoxyethylene soybean amine (Ethomeen S/25) with an HLB value of 15.5 and a molecular weight of 930 shown in Table 1 instead of the ethylene oxide condensate of sorbitan monooleate (Tween 80) to prepare a lubricant oil composition F. The lubricant oil composition F had a friction reduction-retainable highest temperature 100° C. and an average coefficient of friction of 0.050.

Examples 7–8

The same components as the lubricant oil composition A of Example 1 were used except using polyoxyethylene beef tallow amine (Ethomeen T/25) with an HLB value of 15.5 and a molecular weight of 925 (Example 7) and polyoxyethylene beef tallow diamine (Ethoduomeen T/25) with an HLB value of 15.5 and a molecular weight of 980 (Example 8), which are shown in Table 1, to prepare lubricant compositions G and H, respectively. The lubricant oil composition G had a friction reduction-retainable highest temperature of 90° C. and an average coefficient of friction of 0.054. The lubricant oil composition H had 90° C. and 0.057.

Comparative Example 1

To a solvent-refined paraffin mineral oil (kinematic viscosity: 5.1 $mm^2/s$@100° C.) having no alkylene oxide-added nonionic surfactant thereto were mixed 5.3 wt % of a non-dispersion type viscosity index improver, 8.0 wt % of succinimide, 0.09 wt % (as P) of zinc dithiophosphate, and 6.4 wt % in total of a metallic detergent, a pour point depressant, and an antifoaming agent as other additives, and 3.0 wt % of the soot in oil was mixed thereto in the same manner as Example 1 to prepare a lubricant oil composition A.

The lubricant oil composition had a friction reduction-retainable temperature of only 60° C. and an average coefficient of friction of 0.114.

Comparative Examples 2–3

The same components as the lubricant oil composition A of Example 1 were used except using sorbitan trioleate (Span 85)(Comparative Example 2) and sorbitan monooleate (Span 80) (Comparative Example 3) instead of the ethylene oxide condensate of sorbitan monooleate (Tween 80) to prepare lubricant oil compositions B and C. The lubricant oil composition b had a friction reduction-retainable highest temperature of 70° C. and an average coefficient of friction of 0.081. The lubricant oil composition C had 80° C. and 0.077.

Comparative Examples 4–6

The same components as the lubricant oil composition A of Example 11 were used except using polyoxyethylene stearyl ether (BS-4) (Comparative Example 4), polyoxyethylene lauryl ether (BL-4.2) (Comparative Example 5) and polyoxyethylene secondary alkyl ether (BT-12) (Comparative Example 6) instead of the ethylene oxide condensate of sorbitan monooleate (Tween 80) to prepare lubricant oil compositions D, E and F. The lubricant oil compositions D, E, and F had friction reduction-retainable temperatures of 70° C., 70° C. and 80° C. and average coefficients of friction of 0.077, 0.082, and 0.072, respectively.

Comparative Examples 7 and 9

The same components as the lubricant oil composition A of Example 1 were used except using polyoxyethylene oleyl amide (TAMDO-50) (Comparative Example 7) and polyoxyethylene coconut acid amine (Ethomeen C/25) (Comparative Example 9) instead of the ethylene oxide condensate of sorbitan monooleate (Tween 80) to prepare lubricant oil compositions G and I. The lubricant oil compositions G and I had friction reduction-retainable highest temperatures of 80° C. and 60° C. and average coefficients of friction of 0.071 and 0.096, respectively.

Comparative Example 8

The same components as the lubricant oil composition A of Example 1 except using ethylene oxide of sorbitan monostearate (TS-106) instead of the ethylene oxide condensate of sorbitan monooleate to prepare a lubricant oil composition h. The lubricant oil composition h had a friction reduction-retainable highest temperature as low as 60° C., and an average coefficient of friction coefficient of 0.096.

TABLE 1

| Lubricant Oil Composition | Ex. 1 A | Ex. 2 B | Ex. 3 C | Ex. 4 D | Ex. 5 E | Ex. 6 F | Ex. 7 G | Ex. 8 H |
|---|---|---|---|---|---|---|---|---|
| Base oil: Mineral Oil (100%)[1] | Balance | Balance | Balance | Balance | Balance | Balance | Balance | Balance |
| Alkylene oxide-added nonionic surfactant (wt %) | | | | | | | | |
| Chemical substance name (Separately described) | (1) | (2) | (3) | (4) | (5) | (6) | (7) | (8) |
| Corresponding General Formula | III | III | I | I | I | IV | IV | V |
| HLB value | 19.0 | 15.0 | 19.0 | 18.0 | 17.0 | 15.5 | 15.5 | 15.5 |
| Molecular weight (mole number) | 1325 | 1327 | 1012 | 1150 | 1150 | 930 | 925 | 980 |
| Specific Gravity | 1.080 | 1.065 | 1.085 | 1.020 | 1.070 | 1.030 | 1.028 | 0.94 |
| Polymerization number of ethylene oxide (n) | 20 | 20 | 18 | 20 | 20 | 15 | 15 | 15 |
| Alkyl group chain length (Carbon number) | 18 | 18 | 9 | 18 | 18 | 17–18 | 17–18 | 17–18 |
| Addition quantity (wt %) | 5.0 | 5.0 | 5.0 | 5.0 | 5.0 | 5.0 | 5.0 | 5.0 |
| Additives (wt %) | | | | | | | | |
| Viscosity index improver: Non-dispersion type OCP | 5.3 | 5.3 | 5.3 | 5.3 | 5.3 | 5.3 | 5.3 | 5.3 |
| Ashless dispersant: Succinimide | 8.0 | 8.0 | 8.0 | 8.0 | 8.0 | 8.0 | 8.0 | 8.0 |
| ZnDTP (wt % as P) | 0.09 | 0.09 | 0.09 | 0.09 | 0.09 | 0.09 | 0.09 | 0.09 |
| Other additives[2] (wt %) | 6.4 | 6.4 | 6.4 | 6.4 | 6.4 | 6.4 | 6.4 | 6.4 |
| Soot content in oil (wt %) | 3.0 | 3.0 | 3.0 | 3.0 | 3.0 | 3.0 | 3.0 | 3.0 |
| Friction reduction-retainable highest temperature (° C.) | 100 | 90 | 90 | 100 | 100 | 100 | 90 | 90 |
| Average coefficient of friction[4] in SRV friction test[3] | 0.044 | 0.051 | 0.059 | 0.057 | 0.059 | 0.050 | 0.054 | 0.057 |

[1]Base oil Viscosity @ 100° C.: 5.1 $mm^2/s$.
[2]Other additives: 6.4 wt % in total of metal detergent, pour point depressant, and antifoaming agent were added at the same kind and content.
[3]SRV friction test: Load (400 N), frequency (50 Hz), amplitude (1.5 mm), time (5 min).
[4]SRV average friction coefficient: Average of respective coefficients of friction obtained in tests at 40, 50, 60, 70, 80, 90 and 100° C.

TABLE 2

| Lubricant oil Composition | C. Ex. 1 a | C. Ex. 2 b | C. Ex. 3 c | C. Ex. 4 d | C. Ex. 5 e | C. Ex. 6 f | C. Ex. 7 g | C. Ex. 8 h | C. Ex. 9 I |
|---|---|---|---|---|---|---|---|---|---|
| Base oil: Mineral oil (100%)[1] | Balance | Balance | Balance | Balance | Balance | Balance | Balance | Balance | Balance |
| Alkylene oxide-added nonionic surfactant (wt %) | | | | | | | | | |
| Chemical substance name (Separately described) | — | (9) | (10) | (11) | (12) | (13) | (14) | (15) | (16) |

TABLE 2-continued

| Lubricant oil Composition | C. Ex. 1 a | C. Ex. 2 b | C. Ex. 3 c | C. Ex. 4 d | C. Ex. 5 e | C. Ex. 6 f | C. Ex. 7 g | C. Ex. 8 h | C. Ex. 9 I |
|---|---|---|---|---|---|---|---|---|---|
| Corresponding General Formula | — | — | — | I | I | I | — | III | IV |
| HLB value | — | 1.8 | 4.3 | 9.0 | 11.5 | 14.5 | 11.0 | 9.6 | 15.5 |
| Molecular weight (mole number) | — | 956 | 428 | 392 | 370 | 742 | 516 | 711 | 860 |
| Specific Gravity | — | 0.95 | 0.99 | 0.96 | 0.962 | 1.03 | 0.99 | 0.96 | 1.05 |
| Polymerization number of ethylene oxide (n) | — | 1 | 1 | 4 | 4 | 12 | 5 | 6 | 15 |
| Alkyl group chain length (Carbon number) | — | 18 | 18 | 18 | 9 | 12–14 | 18 | 18 | 12 |
| Addition quantity (wt %) | 0.0 | 5.0 | 5.0 | 5.0 | 5.0 | 5.0 | 5.0 | 5.0 | 5.0 |
| Additives (wt %) | | | | | | | | | |
| Viscosity index improver: Non-dispersion type OCP | 5.3 | 5.3 | 5.3 | 5.3 | 5.3 | 5.3 | 5.3 | 5.3 | 5.3 |
| Ashless dispersant: Succinimide | 8.0 | 8.0 | 8.0 | 8.0 | 8.0 | 8.0 | 8.0 | 8.0 | 8.0 |
| ZnDTP (P: wt %) | 0.09 | 0.09 | 0.09 | 0.09 | 0.09 | 0.09 | 0.09 | 0.09 | 0.09 |
| Other additives[2] (wt %) | 6.4 | 6.4 | 6.4 | 6.4 | 6.4 | 6.4 | 6.4 | 6.4 | 6.4 |
| Soot content in oil (wt %) | 3.0 | 3.0 | 3.0 | 3.0 | 3.0 | 3.0 | 3.0 | 3.0 | 3.0 |
| Friction reduction-retainable highest temperature (° C.) | 60 | 70 | 80 | 70 | 70 | 80 | 80 | 80 | 60 |
| Average coefficient of friction[4] in SRV friction test[3] | 0.114 | 0.081 | 0.077 | 0.077 | 0.082 | 0.072 | 0.071 | 0.073 | 0.096 |

[1]Base oil Viscosity @ 100: 5.1 $mm^2/s$.
[2]Other additives: 6.4 wt % in total of metal detergent, pour point depressant, and antifoaming agent were added at the same kind and content.
[3]SRV friction test: Load (400 N), frequency (50 Hz), amplitude (1.5 mm), time (5 min).
[4]SRV average friction coefficient: Average of respective coefficients of friction obtained in tests at 40, 50, 60, 70, 80, 90 and 100° C.

It is apparent from the above results of Examples and Comparative Examples that the lubricant oil compositions (Examples 1–8) containing alkylene oxide-added nonionic surfactants with a specified HLB value of 15 or more and a molecular weight of 900 or more show low coefficients of friction in the SRV friction test, while the lubricant oil compositions (Comparative Examples 2 and 9) containing alkylene oxide-added nonionic surfactants not satisfying either the HLB or the molecular weight are lacking in the friction reducing property.

The lubricant oil composition for internal combustion engines of this invention is enhanced in friction reducing property even under lubricating conditions with soot included in oils, and suitable particularly as a lubricant oil for diesel engine equipped with EGR because of its high friction reduction-retainable temperature and small coefficient of friction in a wide temperature range.

What is claimed is:

1. A lubricant oil composition for internal combustion engines comprising a lubricant base oil incorporated with 0.01 wt % or more, based on the total weight of the lubricant oil composition, of a nonionic surfactant, with alkylene oxide added thereto, consisting of at least one compound selected from the group consisting of general formulae (III) to (VI)

wherein said general formulae (III) to (VI) are:

(III)

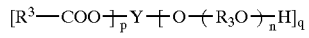

(IV)

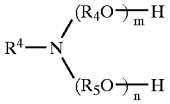

-continued (V)

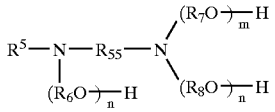

(VI)

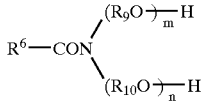

wherein $R^3$, $R^4$, $R^5$ and $R^6$, which may be the same or different, each represents an alkyl group having 8–30 carbon atoms; an alkenyl group having 8–30 carbon atoms; an aromatic hydrocarbon group having 6–30 carbon atoms; or an aromatic hydrocarbon group substituted by at least one alkyl group or alkenyl group having 8–24 carbon atoms; and wherein $R_3$–$R_{10}$, which may be the same or different, each represents an alkylene group; and wherein m and n, which may be the same or different, each represents the polymerization number of alkylene oxides; and wherein Y represents the frame part of a polyhydric alcohol component; and wherein p and q each represents an integer of 1 or more, and the total thereof is not more than the number of hydroxyl groups of the polyhydric alcohol; and wherein $R_{55}$ represents an alkylene group; and wherein at least one of said compound has an HLB value of about 15 or more and a molecular weight of about 900 or more.

2. A method for sustaining the friction reducing properties of a lubricant oil contaminated with soot present in combustion exhaust gas, comprising using a lubricant oil composition for internal combustion engines incorporated with 0.01 wt % or more, based on the total weight of the lubricant oil composition, of a nonionic surfactant, with alkylene oxide added thereto, consisting of at least one compound selected from the group consisting of general formulae (I) to (VI)

wherein said general formulae (I) to (VI) are:

(I)

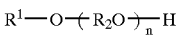

(II)

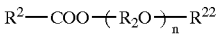

(III)

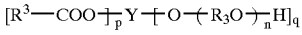

(IV)

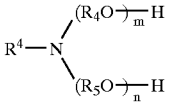

(V)

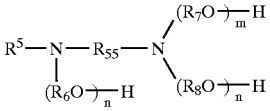

(VI)

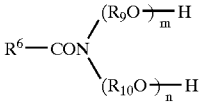

wherein $R^1$, $R^2$, $R^4$, $R^5$ and $R^6$, which may be the same or different, each represents an alkyl group having 8–30 carbon atoms; an alkenyl group having 8–30 carbon atoms; an aromatic hydrocarbon group having 6–30 carbon atoms; or an aromatic hydrocarbon group substituted by at least one alkyl group or alkenyl group having 8–24 carbon atoms; and wherein $R_1$–$R_{10}$, which may be the same or different, each represents an alkylene group; and wherein m and n, which may be the same or different, each represents the polymerization number of alkylene oxides; and wherein Y represents the frame part of a polyhydric alcohol component; and wherein p and q each represents an integer of 1 or more, and the total thereof is not more than the number of hydroxyl groups of the polyhydric alcohol; and wherein $R_{55}$ represents an alkylene group; and having an HLB value of about 15 or more and a molecular weight of about 900 or more.

3. A friction reducing method for internal combustion engines according to claim 2 wherein the internal combustion engine is a diesel engine equipped with an exhaust gas recirculation system.

* * * * *